US010573441B2

(12) United States Patent
Noguchi et al.

(10) Patent No.: US 10,573,441 B2
(45) Date of Patent: Feb. 25, 2020

(54) METHOD FOR MANUFACTURING MAGNETIC CORE

(71) Applicant: HITACHI METALS, LTD., Tokyo (JP)

(72) Inventors: Shin Noguchi, Mishima-gun (JP); Kazunori Nishimura, Mishima-gun (JP); Toshio Mihara, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/325,741

(22) PCT Filed: Jul. 16, 2015

(86) PCT No.: PCT/JP2015/070346

§ 371 (c)(1),
(2) Date: Jan. 12, 2017

(87) PCT Pub. No.: WO2016/010099

PCT Pub. Date: Jan. 21, 2016

(65) Prior Publication Data

US 2017/0178775 A1 Jun. 22, 2017

(30) Foreign Application Priority Data

Jul. 16, 2014 (JP) ..... 2014-145871

(51) Int. Cl.
*H01F 1/147* (2006.01)
*H01F 41/02* (2006.01)
(Continued)

(52) U.S. Cl.
CPC ..... *H01F 1/147* (2013.01); *B22F 1/0003* (2013.01); *B22F 3/24* (2013.01); *B22F 5/00* (2013.01);
(Continued)

(58) Field of Classification Search
CPC ..... H01F 41/0206; H01F 41/0246; H01F 41/0266; H01F 1/147; H01F 1/14766;
(Continued)

(56) References Cited

U.S. PATENT DOCUMENTS 6,284,060 B1 * 9/2001 Matsutani ..... H01F 41/0246 148/300
2002/0084882 A1 * 7/2002 Moro ..... H01F 41/0246 336/233
(Continued)

FOREIGN PATENT DOCUMENTS

JP 06132109 A * 5/1994
JP 10-324960 A 12/1998
(Continued)

OTHER PUBLICATIONS

Machine (English)Translation of Japanese Patent Publication, JP 2010-272608, May 2018.*
(Continued)

*Primary Examiner* — A. Dexter Tugbang
(74) *Attorney, Agent, or Firm* — Sughrue Mion, PLLC

(57) ABSTRACT

There is provided a magnetic core having both high strength and high resistivity, a coil component produced with such a magnetic core, and a magnetic core manufacturing method capable of easily manufacturing a magnetic core with high strength and high resistivity. A method for manufacturing a magnetic core having a structure including dispersed Fe-based soft magnetic alloy particles includes: a first step including mixing a first Fe-based soft magnetic alloy powder containing Al and Cr, a second Fe-based soft magnetic alloy powder containing Cr and Si, and a binder; a second step including pressing the mixture obtained after the first step; and a third step including heat-treating the compact obtained after the second step, wherein the heat treatment forms an oxide layer on the surface of Fe-based soft magnetic alloy
(Continued)

particles and bonds the Fe-based soft magnetic alloy particles together through the oxide layer.

6 Claims, 4 Drawing Sheets

(51) Int. Cl.

| | |
|---|---|
| ***B22F 1/00*** | (2006.01) |
| ***C22C 38/34*** | (2006.01) |
| ***C22C 38/00*** | (2006.01) |
| ***H01F 1/24*** | (2006.01) |
| ***C22C 38/18*** | (2006.01) |
| ***B22F 5/00*** | (2006.01) |
| ***C22C 33/02*** | (2006.01) |
| ***C22C 38/06*** | (2006.01) |
| ***B22F 5/10*** | (2006.01) |
| ***B22F 3/24*** | (2006.01) |

(52) U.S. Cl.
CPC ..... *B22F 5/10* (2013.01); *C22C 33/0257* (2013.01); *C22C 38/00* (2013.01); *C22C 38/06* (2013.01); *C22C 38/18* (2013.01); *C22C 38/34* (2013.01); *H01F 1/24* (2013.01); *H01F 41/0206* (2013.01); *H01F 41/0246* (2013.01); *H01F 41/0266* (2013.01); *B22F 1/0011* (2013.01); *B22F 2003/248* (2013.01); *B22F 2998/10* (2013.01); *Y10T 29/4902* (2015.01); *Y10T 29/49069* (2015.01); *Y10T 29/49075* (2015.01)

(58) Field of Classification Search
CPC ..... H01F 1/24; H01F 1/33; H01F 3/08; H01F 41/02; C22C 38/06; C22C 38/18; C22C 38/34; C22C 38/00; C22C 38/0257; C22C 33/02; B22F 3/24; B22F 5/10; B22F 2003/248; B22F 1/00; B22F 1/0003; B22F 1/0011; B22F 5/00; B22F 2998/10; Y10T 29/4902; Y10T 29/49069; Y10T 29/49075
See application file for complete search history.

(56) References Cited

U.S. PATENT DOCUMENTS

| | | | | |
|---|---|---|---|---|
| 2011/0267167 | A1 | 11/2011 | Ogawa et al. | |
| 2012/0153212 | A1* | 6/2012 | Liu | H01F 41/0266 252/62.55 |
| 2013/0056674 | A1* | 3/2013 | Inagaki | H01F 41/0246 252/62.55 |
| 2013/0200970 | A1 | 8/2013 | Ogawa et al. | |

FOREIGN PATENT DOCUMENTS

| | | | |
|---|---|---|---|
| JP | 2000-100614 | A | 4/2000 |
| JP | 2005-220438 | A | 8/2005 |
| JP | 2005-303006 | A | 10/2005 |
| JP | 2006-237153 | A | 9/2006 |
| JP | 2010-272608 | A | 12/2010 |
| JP | 2011-249774 | A | 12/2011 |

OTHER PUBLICATIONS

Machine (English) Translation of Japanese Patent Publication, JP 10-324960, May 2018.*
International Search Report of PCT/JP2015/070346 dated Sep. 29, 2015.
Extended European Search Report dated Oct. 30, 2017 issued by the European Patent Office in EP Application No. 15821833.9, 7 pages.
Communication dated Dec. 5, 2017, issued by the Japanese Patent Office in counterpart Japanese Application No. 2016-534482.
Communication dated Dec. 21, 2017, from Korean Intellectual Property Office in counterpart application No. 10-2017-7002439.
International Preliminary Report on Patentability and translation of Written Opinion issued from the International Bureau in counterpart International Application No. PCT/JP2015/070346 dated Jan. 26, 2017.
Communication dated Feb. 2, 2018 from the State Intellectual Property Office of the P.R.C. in counterpart Application No. 201580037838.0.

* cited by examiner

METHOD FOR MANUFACTURING MAGNETIC CORE

CROSS REFERENCE TO RELATED APPLICATIONS

This application is a National Stage of International Application No. PCT/JP2015/070346 filed Jul. 16, 2015 (claiming priority based on Japanese Patent Application No. 2014-145871 filed Jul. 16, 2014), the contents of which are incorporated herein by reference in their entirety.

TECHNICAL FIELD

The invention relates to a method for manufacturing a magnetic core using Fe-based soft magnetic alloy powders, a magnetic core, and a coil component including a magnetic core and a coil wound on the magnetic core.

BACKGROUND ART

Traditionally, coil components such as inductors, transformers, and chokes are used in a wide variety of applications such as home electric appliances, industrial apparatuses, and vehicles. A coil component is composed of a magnetic core and a coil wound around the magnetic core. In recent years, as a result of downsizing of power supplies for electronic devices, there has been a strong demand for compact low-profile coil components operable even with a large current, and powder magnetic cores produced with a metallic magnetic powder, which has a relatively high saturation magnetic flux density, are increasingly used for such coil components. For example, a soft magnetic alloy powder such as an Fe—Si alloy powder is used as such a metallic magnetic powder. Structures used for coil components include a common structure in which a coil is wound around a powder magnetic core obtained through pressing; and a structure obtained by integrally molding a coil and a magnetic powder so that the compact and low-profile requirements can be satisfied (coil-sealed structure).

Powder magnetic cores obtained through the compaction of a soft magnetic alloy powder such as an Fe—Si alloy powder have high saturation magnetic flux density as compared with oxide magnetic materials such as ferrite. However, the soft magnetic alloy powder used for such powder magnetic cores has low electrical resistivity (specific resistance). Therefore, methods of improving the insulation between soft magnetic alloy particles are used, such as methods of forming an insulating coating on the surface of soft magnetic alloy particles. For example, Patent Document 1 discloses a method of heat-treating, at 400° C. to 900° C., a compact including a group of particles of a soft magnetic alloy including Fe, Si, and Cr or Al, which is a metal element more vulnerable to oxidation than Fe, and also discloses a magnetic including particles bonded together through an oxide layer formed by the heat treatment. The object thereof is to obtain a magnetic core with high magnetic permeability and high saturation magnetic flux density without the need for high pressure during molding.

Patent Document 2 discloses an example using an Fe—Cr—Al magnetic powder, which can produce, by itself, a high-electric-resistance material capable of serving as an insulating coating.

PRIOR ART DOCUMENTS

Patent Documents

Patent Document 1: JP-A-2011-249774
Patent Document 2: JP-A-2005-220438

SUMMARY OF THE INVENTION

Problems to be Solved by the Invention

The magnetic core described in Patent Document 1 can have a resistivity of more than $1\times10^3$ Ω·m when produced under the heat treatment conditions shown in the examples. However, its rupture stress does not reach even 100 MPa, and its strength is at a level similar to that of ferrite magnetic cores. According to the document, when the heat treatment temperature is increased to 1,000° C., the rupture stress is increased to 20 kgf/mm$^2$ (196 MPa), but the resistivity is significantly decreased to $2\times10^2$ Ω·cm (2 Ω·m). This means that high resistivity and high strength have not yet been achieved simultaneously.

Patent Document 2 shows that the electric resistance of the magnetic core can be increased about 2.5 times by forming an oxide film. However, the electric resistance value itself is only about several mΩ regardless of the presence or absence of the oxide film.

In view of the problems, an object of the invention is to provide a magnetic core having both high strength and high resistivity, a coil component produced with such a magnetic core, and a magnetic core manufacturing method capable of easily manufacturing a magnetic core with high strength and high resistivity.

Means for Solving the Problems

The invention is directed to a method for manufacturing a magnetic core having a structure including dispersed Fe-based soft magnetic alloy particles, the method including: a first step including mixing a first Fe-based soft magnetic alloy powder containing Al and Cr, a second Fe-based soft magnetic alloy powder containing Cr and Si, and a binder; a second step including pressing the mixture obtained after the first step; and a third step including heat-treating the compact obtained after the second step, wherein the heat treatment forms an oxide layer on the surface of Fe-based soft magnetic alloy particles and bonds the Fe-based soft magnetic alloy particles together through the oxide layer.

In the magnetic core manufacturing method, a mass ratio of the first Fe-based soft magnetic alloy powder to the total of the first and second Fe-based soft magnetic alloy powders is preferably 40% or more.

The invention is also directed to a magnetic core having a structure including dispersed Fe-based soft magnetic alloy particles, in which the Fe-based soft magnetic alloy particles include first Fe-based soft magnetic alloy particles containing Al and Cr and second Fe-based soft magnetic alloy particles containing Cr and Si, and the Fe-based soft magnetic alloy particles are bonded together through an oxide layer formed on the surface of the particles.

The invention is also directed to a coil component including the magnetic core and a coil wound on the magnetic core.

Effect of the Invention

The invention makes it possible to provide a magnetic core having both high strength and high resistivity, a coil component produced with such a magnetic core, and a magnetic core manufacturing method capable of easily manufacturing a magnetic core with high strength and high resistivity.

MODE FOR CARRYING OUT THE INVENTION

Hereinafter, embodiments of the magnetic core manufacturing method, the magnetic core, and the coil component according to the invention will be described specifically. It will be understood that they are not intended to limit the invention.

Figure 1:
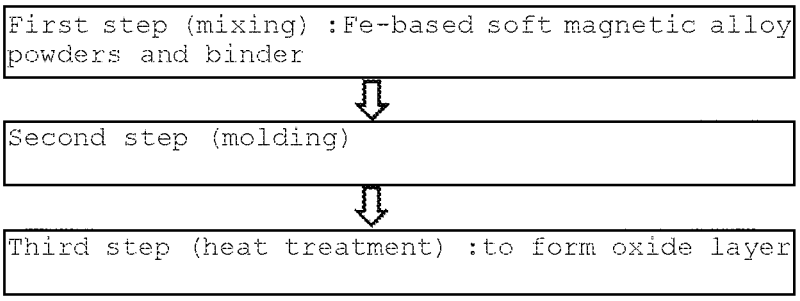
FIG. 1 is a process flowchart for illustrating an embodiment of the magnetic core manufacturing method according to the invention.

FIG. 1 is a process flowchart for illustrating an embodiment of the magnetic core manufacturing method according to the invention. The manufacturing method is a method for manufacturing a magnetic core having a structure including dispersed Fe-based soft magnetic alloy particles. The manufacturing method includes a first step including mixing a first Fe-based soft magnetic alloy powder containing Al and Cr, a second Fe-based soft magnetic alloy powder containing Cr and Si, and a binder; a second step including pressing the mixture obtained after the first step; and a third step including heat-treating the compact obtained after the second step. The structure including dispersed Fe-based soft magnetic alloy particles is a structure composed of aggregated Fe-based soft magnetic alloy particles. The heat treatment forms an oxide layer on the surface of Fe-based soft magnetic alloy particles and bonds the Fe-based soft magnetic alloy particles together through the oxide layer. Therefore, the resulting magnetic core includes Fe-based soft magnetic alloy particles and an oxide phase interposed between the Fe-based soft magnetic alloy particles. As used herein, the term "oxide phase" is intended to include a grain boundary oxide layer between two Fe-based soft magnetic alloy particles and a triple-point grain boundary oxide between three Fe-based soft magnetic alloy particles, such as an oxide having no layered structure.

The first Fe-based soft magnetic alloy powder used in the invention is an Fe—Al—Cr soft magnetic alloy powder including Fe, which constitutes the highest percentage by mass of the alloy, and further including Al and Cr. The second Fe-based soft magnetic alloy powder is an Fe—Cr—Si soft magnetic alloy powder including Fe, which constitutes the highest percentage by mass of the alloy, and further including Si and Cr. The use of the Fe—Cr—Si soft magnetic allow powder for the magnetic core is advantageous for high corrosion resistance and low core loss, but disadvantageous for improving the strength of the magnetic core because it requires high pressure for pressing. On the other hand, the Fe—Al—Cr soft magnetic alloy powder has high corrosion resistance like the Fe—Cr—Si soft magnetic alloy powder as compared with an Fe—Si alloy powder, and is more plastically deformable than the Fe—Si or Fe—Cr—Si alloy powder. Therefore, using not only the Fe—Cr—Si soft magnetic alloy powder but also the Fe—Al—Cr soft magnetic alloy powder makes it possible to obtain, even at low pressure, a magnetic core with high space factor and high strength. This makes it possible to avoid the use of a large and/or complicated pressing machine. In addition, the ability to press at low pressure suppresses mold breakage and improves productivity.

In addition, as described below, the heat treatment after the pressing successfully forms an insulating oxide layer on the surfaces of the Fe—Al—Cr soft magnetic alloy particles and the Fe—Cr—Si soft magnetic alloy particles. Therefore, the step of forming an insulating oxide before pressing can be omitted, and the method of forming an insulting coating can also be simplified. These features also make it possible to improve productivity. As the oxide layer is formed, the Fe-based soft magnetic alloy particles are bonded together through the oxide layer to form a magnetic core with high strength.

First, a description will be given of the Fe-based soft magnetic alloy powders to be subjected to the first step in an embodiment of the magnetic core manufacturing method according to the invention. Hereinafter, unless otherwise specified, contents and percentages are by mass. The first Fe-based soft magnetic alloy powder includes Fe as a main component, of which the content is the highest among the components constituting the soft magnetic alloy, and includes Al and Cr as sub-components. In other words, Fe, Al, and Cr are three main metal elements, of which the contents are relatively high. The second Fe-based soft magnetic alloy powder includes Fe as a main component, of which the content is the highest among the components constituting the soft magnetic alloy, and includes Cr and Si as sub-components. In other words, Fe, Cr, and Si are three main metal elements, of which the contents are relatively high. The Al and Cr contents of the first Fe-based soft magnetic alloy powder and the Cr and Si contents of the second Fe-based soft magnetic alloy powder are not limited as long as they can form a magnetic core. Hereinafter, preferred features will be described.

Fe is a main magnetic element constituting the Fe-based soft magnetic alloy powder. In order to ensure high saturation magnetic flux density, the Fe-based soft magnetic alloy powder preferably has an Fe content of 80% by mass or more.

In the first Fe-based soft magnetic alloy powder, Cr and Al are elements capable of improving corrosion resistance and other properties. For the improvement of corrosion resistance and other properties, the Cr content is preferably 1.0% by mass or more, more preferably 2.5% by mass or more. On the other hand, as the nonmagnetic Cr content increases, the saturation magnetic flux density tends to decrease. Therefore, the Cr content is preferably 9.0% by mass or less, more preferably 7.0% by mass or less, even more preferably 4.5% by mass or less.

Al is also an element capable of improving corrosion resistance as mentioned above. In particular, Al contributes to the formation of an oxide on the surface of the Fe-based soft magnetic alloy particles. From these points of view, the Al content is preferably 2.0%, by mass or more, more preferably 3.0% by mass or more, even more preferably 5.0% by mass or more. On the other hand, as the nonmagnetic Al content increases, the saturation magnetic flux density tends to decrease. Therefore, the Al content is preferably 10.0% by mass or less, more preferably 8.0% by mass or less, even more preferably 6.0% by mass or less. Al also contributes to the improvement of the space factor. It is therefore preferable to use an Fe-based soft magnetic alloy powder higher in Al content than in Cr content.

In the second Fe-based soft magnetic alloy powder, Cr is an element capable of improving corrosion resistance and other properties as mentioned above. For the improvement of corrosion resistance and other properties, the Cr content is preferably 1.0% by mass or more, more preferably 2.5% by mass or more. On the other hand, as the nonmagnetic Cr content increases, the saturation magnetic flux density tends to decrease. Therefore, the Cr content is preferably 9.0% by mass or less, more preferably 7.0% by mass or less, even more preferably 4.5% by mass or less.

Si is an element capable of improving electrical resistivity and magnetic permeability. From this point of view, the Si content is preferably, for example, 1.0% by mass or more, more preferably 2.0% by mass or more. On the other hand, too high a Si content can significantly reduce the saturation magnetic flux density. Therefore, the Si content is preferably 10.0% by mass or less, more preferably 6.0% by mass or less, even more preferably 4.0% by mass or less.

The Fe-based soft magnetic alloy powder may also contain a magnetic element such as Co or Ni and a nonmagnetic element other than Al and Cr. The Fe-based soft magnetic alloy powder may also contain inevitable manufacturing impurities.

The first Fe-based soft magnetic alloy powder may contain, for example, Si, Mn, C, P, S, O, and N as inevitable impurities. In other words, the first Fe-based soft magnetic alloy powder may include Al, Cr, and the remainder including Fe and inevitable impurities. The contents of such inevitable impurities are preferably as follows: Si<1.0% by mass, Mn≤1.0% by mass, C≤0.05% by mass, O≤0.3% by mass, N≤0.1% by mass, P≤0.02% by mass, S≤0.02% by mass. Among them, Si is disadvantageous for improving radial crushing strength. Therefore, the content of Si in the first Fe-based soft magnetic alloy powder is preferably controlled to less than 0.5% by mass (Si<0.5% by mass). The Si content is more preferably 0.4% by mass or less. In this regard, however, it is not practical in terms of mass productivity to reduce the content of impurity elements to far less than the usual level after the normal manufacturing process. Therefore, for example, it is preferable to allow the Si content of the first Fe-based soft magnetic alloy powder to be 0.02% or more.

On the other hand, the second Fe-based soft magnetic alloy powder may contain, for example, Mn, C, P, S, O, and N as inevitable impurities. In other words, the second Fe-based soft magnetic alloy powder may include Cr, Si, and the remainder including Fe and inevitable impurities. The contents of such inevitable impurities are preferably as follows: Mn≤1.0% by mass, C≤0.05% by mass, O≤0.3% by mass, N≤0.1% by mass, P≤0.02% by mass, S≤0.02% by mass.

Each Fe-based soft magnetic alloy powder may have any average particle size (in this case, any median diameter d50 in the cumulative particle size distribution). For example, each Fe-based soft magnetic alloy powder used may have an average particle size of 1 μm or more and 100 μm or less. The high-frequency properties can be improved by reducing the average particle size. Therefore, the median diameter d50 is preferably 30 μm or less, more preferably 20 μm or less, even more preferably 15 μm or less. On the other hand, as the average particle size decreases, the magnetic permeability tends to decrease. Therefore, the median diameter d50 is more preferably 5 μm or more. In addition, coarse particles are more preferably removed from the Fe-based soft magnetic alloy powders using a sieve or other means. In this case, Fe-based soft magnetic alloy powders with particle sizes at least under 32 μm (in other words, having passed through a sieve with an aperture of 32 pun) are preferably used.

There may be any relationship between the average particle sizes of the first and second Fe-based soft magnetic alloy powders. For example, in view of formability, the second Fe-based soft magnetic alloy powder, which is relatively hard and low in formability, preferably has a relatively small average particle size, whereas in view of core loss, the first Fe-based soft magnetic alloy powder, which can have relatively high core loss, preferably has a relatively small average particle size.

The Fe-based soft magnetic alloy powders may be in any form. In view of fluidity and other properties, granular powders such as atomized powders are preferably used. An atomization method such as gas atomization or water atomization is suitable for the production of powders of alloys that have high malleability or ductility and are hard to grind. An atomization method is also advantageous for obtaining substantially spherical particles of Fe-based soft magnetic alloys.

The addition of the first Fe-based soft magnetic alloy powder to the second Fe-based soft magnetic alloy powder is expected to improve formability and strength, and the first and second Fe-based soft magnetic alloy powders may be mixed in any ratio. In a preferred mode, the mass ratio of the first Fe-based soft magnetic alloy powder to the total of the first and second Fe-based soft magnetic alloy powders is 40% or more so that the first Fe-based soft magnetic alloy powder can be sufficiently effective in increasing strength. Any other magnetic powder may also be added to the first and second Fe-based soft magnetic alloy powders.

As described above, the use of the Fe—Al—Cr soft magnetic alloy powder is effective in improving the strength and other properties of the magnetic core. As long as the Fe—Al—Cr soft magnetic alloy powder is added, therefore, a certain degree of effect can be achieved even when any of a wide variety of Fe-based soft magnetic alloy powders other than the Fe—Cr—Si soft magnetic alloy powder is used as the second Fe-based soft magnetic alloy powder. In this case, other soft magnetic alloy powder used is preferably capable of forming an oxide layer on the surface of soft magnetic alloy particles upon the heat treatment like the Fe—Al—Cr soft magnetic alloy powder and the Fe—Cr—Si soft magnetic alloy powder. Other Fe-based soft magnetic alloy powder may be, for example, an Fe—Si soft magnetic alloy powder. An Fe-based soft magnetic alloy powder with a lower hardness than the Fe—Al—Cr soft magnetic alloy powder containing Al may also be used as the second Fe-based soft magnetic alloy powder. In this case, the effect of the addition of the first Fe-based soft magnetic alloy powder can be enhanced in an additive manner. Also in this case, the oxide layer is more preferably rich in a subcomponent other than Fe as a magnetic element.

Although, as mentioned above, any Fe-based soft magnetic alloy powder other than the Fe—Cr—Si soft magnetic alloy powder may be used as the second Fe-based soft magnetic alloy powder, the Fe—Cr—Si soft magnetic alloy powder should preferably be used as the second Fe-based soft magnetic alloy powder because of its advantages such as high corrosion resistance.

Next, the binder used in the first step will be described. During the pressing, the binder binds the particles to impart, to the compact, a strength enough to withstand handling after the pressing. The binder may be of any type. For example, any of various organic binders such as polyethylene, polyvinyl alcohol, and acrylic resin may be used. Organic binders are thermally decomposed by the heat treatment after the pressing. Therefore, an inorganic binder, such as a silicone resin, capable of remaining as a solid and binding the particles even after the heat treatment may be used in combination with an organic binder. In the magnetic core manufacturing method according to the invention, however, the oxide layer formed in the third step can function to bind the Fe-based soft magnetic alloy particles. Therefore, the process should preferably be simplified by omitting the use of the inorganic binder.

The content of the binder is preferably such that the binder can be sufficiently spread between the Fe-based soft magnetic alloy particles to ensure a sufficient compact strength. However, too high a binder content can reduce the density or strength. From these points of view, the binder content is preferably, for example, from 0.5 to 3.0 parts by weight based on 100 parts by weight of the Fe-based soft magnetic alloy powders.

The binder may be added and mixed into the mixture of the first and second Fe-based soft magnetic alloy powders, or the first and second Fe-based soft magnetic alloy powders and the binder may be mixed simultaneously. Alternatively, one of the first and second Fe-based soft magnetic alloy powders may be mixed with the binder, and then the other may be added and mixed into the resulting mixture. In this regard, the first step may include mixing a granulated powder of the first Fe-based soft magnetic alloy and a granulated powder of the second Fe-based soft magnetic alloy because the granulated powder contains the binder as described below. In view of uniformity, however, the first and second Fe-based soft magnetic alloy powders are more preferably mixed before the granulation.

In the first step, the Fe-based soft magnetic alloy powders and the binder may be mixed by any method. A conventionally known mixing method or a conventionally known mixer may be used to mix them. When being mixed with the binder, the mixed powder forms an aggregated powder with a wide particle size distribution due to the binding action of the binder. Therefore, the resulting mixed powder may be allowed to pass through a sieve, for example, using a vibrating sieve, so that a granulated powder (granules) with a desired secondary particle size suitable for pressing can be obtained. Alternatively, a wet granulation method such as spray-dry granulation may also be used. In particular, spray-dry granulation using a spray dryer is preferred, which makes it possible to form substantially spherical granules and to obtain a large amount of granules with a reduced time of exposure to heated air. In addition, a lubricant such as stearic acid or a stearic acid salt is preferably added to the powder in order to reduce the friction between the powder and the die during pressing. The content of the lubricant is preferably from 0.1 to 2.0 parts by weight based on 100 parts by weight of the Fe-based soft magnetic alloy powders. Alternatively, the lubricant may also be applied to the die.

Next, a description will be given of the second step including molding the mixture obtained after the first step. The mixture obtained in the first step is preferably granulated as described above and then subjected to the second step. For example, the granulated mixture is pressed into a predetermined shape such as a toroidal shape or a rectangular solid shape using a die. The use of the Fe—Cr—Al soft magnetic alloy powder as an Fe-based soft magnetic alloy powder makes it possible to increase the space factor (relative density) of the powder magnetic core even at low pressure and to improve the strength of the powder magnetic core. On the basis of these effects, the space factor of the soft magnetic material particles in the powder magnetic core after the heat treatment is preferably set in the range of 80 to 90%. This range is preferred because an increase in the space factor can improve the magnetic properties but an excessive increase in the space factor can increase the facility burden and cost. The space factor is more preferably in the range of 82 to 90%.

In this regard, since a mixed powder of the first and second Fe-based soft magnetic alloy powders is used, the true density (the density of the alloy particles themselves) should be the massed average of the true densities of the first and second Fe-based soft magnetic alloy powders based on the mixing ratio of each alloy powder. The true density of each Fe-based soft magnetic alloy powder may be the measured density value of an alloy ingot prepared by melting a material with the same composition.

In the second step, the pressing may be room temperature pressing or warm pressing in which heating is performed to such an extent as not to eliminate the binder. The above methods of preparing and pressing the mixture are also not intended to be limiting. For example, sheet molding may be performed instead of the pressing using a die, and the resulting sheets may be stacked and press-bonded to form a compact for a laminated magnetic core. In this case, the mixture is prepared in the form of a slurry, which is supplied to a sheet molding machine such as a doctor blade.

Next, a description will be given of the third step including heat-treating the compact obtained after the second step. The compact after the second step is subjected to a heat treatment for relaxing the stress/strain introduced by the pressing or the like so that good magnetic properties can be obtained. The heat treatment also forms an oxide layer on the surface of the Fe-based soft magnetic alloy particles. The oxide layer is grown by the reaction of oxygen with the Fe-based soft magnetic alloy particles in the heat treatment. The oxide layer is formed by the oxidation reaction, which proceeds beyond the natural oxidation of the Fe-based soft magnetic alloy particles. The formation of the oxide increases the insulation between the Fe-based soft magnetic alloy particles and the corrosion resistance of the Fe-based soft magnetic alloy particles. In addition, the oxide layer, which is formed after the formation of the compact, can contribute to the bonding between the Fe-based soft magnetic alloy particles through the oxide layer. The Fe-based soft magnetic alloy particles bonded together through the oxide layer allow the resulting magnetic core to have high strength.

Specifically, the heat treatment oxidizes each of the first and second Fe-based soft magnetic alloy particles to form an oxide layer on the surface of each particle. Therefore, oxides exist, containing metals from the Fe—Si—Cr alloy powder and the Fe—Al—Cr alloy powder. In this step, Al migrates from the first Fe-based soft magnetic alloy powder to form an Al-rich surface layer, which forms an oxide layer in which the ratio of Al to the sum of Fe, Al, and Cr is higher than that in the inner alloy phase. Typically, among the constituent metal element contents, the Al content and the Fe content are particularly higher and lower than those of the inner alloy phase, respectively. More microscopically, an oxide layer in which the Fe content is higher at its center than in the vicinity of the alloy phase is formed at the grain boundary between the Fe-based soft magnetic alloy particles.

On the other hand, Cr migrates from the second Fe-based soft magnetic alloy powder to form a Cr-rich surface layer, which forms an oxide layer in which the ratio of Cr to the sum of Fe, Cr, and Si is higher than that in the inner alloy phase. The oxide layer formed by the heat treatment in the third step bonds together Fe-based soft magnetic alloy particles adjacent to each other, such as first and second Fe-based soft magnetic alloy particles, first Fe-based soft magnetic alloy particles, and second Fe-based soft magnetic alloy particles.

In the third step, the heat treatment may be performed in an oxygen-containing atmosphere such as the air or a mixed gas of oxygen and inert gas. The heat treatment may also be performed in a water vapor-containing atmosphere such as a mixed gas of water vapor and inert gas. Among them, the heat treatment in the air is simple and preferred. In the third step, the heat treatment may be performed at a temperature that allows the oxide layer to be formed. The heat treatment makes it possible to obtain a high-strength magnetic core. In the third step, the heat treatment is also preferably performed at a temperature that does not allow significant sintering of the Fe-based soft magnetic alloy powders. If the Fe-based soft magnetic alloy powders are significantly sintered, part of the oxide layer can be surrounded by the alloy phase and thus isolated in the form of an island. In this case, the function of the oxide layer to separate alloy phases from one another in the matrix of Fe-based soft magnetic alloy particles can decrease, and the core loss can also increase. Specifically, the heat treatment temperature is preferably in the range of 600 to 900° C., more preferably in the range of 700 to 800° C., even more preferably in the range of 750 to 800° C. The holding time in the above temperature range is appropriately set depending on the size of the magnetic core, the quantity to be treated, the tolerance for variations in properties, or other conditions. The holding time is set to, for example, 0.5 to 4 hours.

Other steps may be added before and after each of the first to third steps. For example, the first step may be preceded by an additional preliminary step including forming an insulating coating on the soft magnetic material powders by a heat treatment, a sol-gel method, or other methods. More preferably, however, this preliminary step should be omitted so that the manufacturing process can be simplified, because an oxide layer is successfully formed on the surface of the Fe-based soft magnetic alloy particles by the third step in the magnetic core manufacturing method according to the invention. The oxide layer itself also resists plastic deformation. Therefore, when the process used includes forming the oxide layer after the pressing, the high formability of the Fe-based soft magnetic alloy powder (specifically, the Fe—Al—Cr soft magnetic alloy powder) can be effectively utilized in the pressing of the second step.

A magnetic core as described below having a structure including dispersed Fe-based soft magnetic alloy particles is obtained by the magnetic core manufacturing method described above. The Fe-based soft magnetic alloy particles include first Fe-based soft magnetic alloy particles containing Al and Cr and second Fe-based soft magnetic alloy particles containing Cr and Si. The Fe-based soft magnetic alloy particles are bonded together through an oxide layer formed on the surface of the particles. The oxide layer-mediated bonding of the Fe-based soft magnetic alloy particles allows the magnetic core to have high strength and high resistivity. The Fe-based soft magnetic alloy particles (hereinafter also simply referred to as "alloy particles") in the magnetic core correspond to the Fe-based soft magnetic alloy powders described above for an embodiment of the manufacturing method. Therefore, a repeated description of their composition and properties will be omitted here. Other features of the magnetic core are also as described above for an embodiment of the manufacturing method. Therefore, a repeated description of such features will be omitted here. It should be noted that since one object of the heat treatment is oxidation, the content of oxygen in the bulk composition of the magnetic core after the heat treatment is higher than the inevitable impurity level of the Fe-based soft magnetic alloy powders before the pressing.

The magnetic core preferably has an average of maximum sizes of each type of alloy particles of 15 μm or less, more preferably 8 μm or less, as measured in its cross-sectional observation image. When the alloy particles constituting the magnetic core are fine, the magnetic core can have improved high-frequency properties as well as improved strength. From this point of view, the percentage of the number of alloy particles with a maximum size of more than 40 μm is preferably less than 1.0% in the cross-sectional observation image of the magnetic core. On the other hand, the alloy particles preferably have an average maximum size of 0.5 μm or more in order to suppress the reduction in magnetic permeability. The average of maximum sizes may be determined by polishing the cross-section of the magnetic core, observing the polished cross-section with a microscope, reading the maximum sizes of at least 30 alloy particles in a field of view with a certain area, and calculating the number average of the maximum sizes. After the pressing, the alloy particles are plastically deformed, but in the cross-sectional observation, the exposed surfaces of most alloy particles are deviated from the center, and therefore, the average of maximum sizes is smaller than the median diameter d50 determined by evaluation of the powder. The percentage of the number of alloy particles with a maximum size of more than 40 μm should be evaluated in a field of view with an area of at least 0.04 $mm^2$ or more.

In the magnetic core after the heat treatment, the oxide layer at the grain boundary preferably has an average thickness of 100 nm or less. The average thickness of the oxide layer refers to the thickness determined by a process that includes observing the cross-section of the magnetic core with a transmission electron microscope (TEM), for example, at a magnification of 600,000; measuring, in the observed field of view, portions where substantially parallel profile lines are observed between adjacent Fe-based soft magnetic alloy particles, to determine the thickness of the portion where the Fe-based soft magnetic alloy particles are closest to each other (the minimum thickness) and to determine the thickness of the portion where the Fe-based soft magnetic alloy particles are most apart from each other (the maximum thickness); and calculating the arithmetic mean of the measured thicknesses. Specifically, the measurement is preferably performed at or around the center of the triple-point grain boundary. If the oxide layer has too large a thickness, the distance between the Fe-based soft magnetic alloy particles will be too large, so that a reduction in magnetic permeability or an increase in hysteresis loss can occur and the proportion of the oxide layer containing a nonmagnetic oxide can increase, which may decrease the saturation magnetic flux density. On the other hand, if the oxide layer has too small a thickness, a tunneling current can flow through the oxide layer to increase eddy-current loss. Therefore, the oxide layer preferably has an average thickness of 10 nm or more. More preferably, the oxide layer has an average thickness of 30 to 80 nm.

The magnetic permeability of the magnetic core necessary for constituting coil components may be determined depending on the intended use. For inductor applications, the magnetic core preferably has an initial magnetic permeability of 30 or more, more preferably 40 or more, even more preferably 50 or more, for example, at 100 kHz. The magnetic core according to the invention has features suitable for achieving both high resistivity and high strength. The features of the magnetic core make it possible to achieve a resistivity of $1\times10^3$ Ω·cm or more or a resistivity of $1\times10^4$ Ω·cm or more. The powder magnetic core according to the invention can also have a radial crushing strength of 120 MPa or more. The radial crushing strength is preferably 150 MPa or more.

Figure 2:
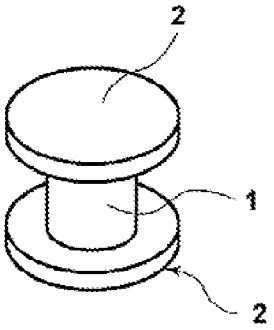
FIG. 2 is a perspective view showing an embodiment of the magnetic core according to the invention.

The magnetic core may have any of various shapes such as toroidal shapes, U-shapes, E-shapes, and drum shapes. In order to take advantage of the high-strength feature, the features of the invention are preferably applied to a drum-shaped magnetic core, which includes, as shown in FIG. 2, a columnar body 1 on which a conductive wire is to be wound; and a flange or flanges 2 provided at one or both ends of the columnar body 1.

A coil component is provided, which includes the magnetic core and a coil wound on the magnetic core. The coil may be formed by winding a conductive wire on the magnetic core or by winding a conductive wire on a bobbin. Such a coil component including the magnetic core and the coil may be used as, for example, a choke, an inductor, a reactor, or a transformer. The frequency band in which the magnetic core and the coil component are operated is typically, but not limited to, 1 kHz or more, preferably 100 kHz or more. The magnetic core and the coil component may also be used for not only stationary induction apparatuses but also rotors.

The magnetic core may be manufactured in the form of a simple powder magnetic core, which is obtained through pressing of only a mixture including the Fe-based soft magnetic alloy powders, the binder, and other components as described above, or may be manufactured to have a structure in which the coil is disposed in the interior. As a non-limiting example, the latter structure may be manufactured as a powder magnetic core of a coil-sealed structure by integrally compression-molding the Fe-based soft magnetic alloy powders and the coil. In a laminated magnetic core, a coil in the form of a patterned electrode is wound in the interior of the magnetic core.

Electrodes for connection to the terminals of the coil may also be formed on the surface of the magnetic core by plating, baking, or other methods. For example, when the electrodes are formed by baking, Ag, Ag—Pd, Cu, or other conductive materials may be used. A film of Ni, Au, Sn, or other conductive materials may also be formed by plating on the conductive film formed by baking. Alternatively, the electrodes may also be formed by physical vapor deposition (PVD) such as sputtering or vapor deposition.

The magnetic core may also be provided with a resin coating for ensuring insulating properties or for other purposes. A part or the whole of the coil component may also be molded with a resin.

EXAMPLES

Powder magnetic cores were prepared as described below using an Fe—Al—Cr soft magnetic alloy powder (first Fe-based soft magnetic alloy powder) and an Fe—Cr—Si soft magnetic alloy powder (second Fe-based soft magnetic alloy powder) as Fe-based soft magnetic alloy powders.

The Fe—Al—Cr soft magnetic alloy powder used was a granular atomized powder, which had a mass percent composition of Fe-5.0% Al-4.0% Cr. The alloy contained 0.2 wt % of Si as the highest content impurity. The atomized powder was classified using a 440-mesh sieve (with an aperture of 32 μm), and the Fe-based soft magnetic alloy powder having passed through the sieve was subjected to the mixing. The average particle size (median diameter d50) of the Fe-based soft magnetic alloy powder having passed through the sieve was measured with a laser diffraction/scattering particle size distribution analyzer (LA-920 manufactured by HORIBA, Ltd.). The measured average particle size (median diameter d50) was 16.8 μm.

The Fe—Cr—Si soft magnetic alloy powder was also a granular atomized powder, which had a mass percent composition of Fe-4.0% Cr-3.5% Si. It had an average particle size (median diameter d50) of 10.4 μm.

The Fe—Al—Cr soft magnetic alloy powder and the Fe—Cr—Si soft magnetic alloy powder were mixed in different ratios. Subsequently, 2.5 parts by weight (0.25 parts by weight on a solid basis) of a PVA binder (POVAL PVA-205 manufactured by KURARAY CO., LTD., solid content 10%) was added to 100 parts by weight of each resulting mixed Fe-based soft magnetic alloy powder and mixed together. The resulting mixed powder was dried at 120° C. for 10 hours. The dried mixed powder was allowed to pass through a sieve to give a granulated powder. Based on 100 parts by weight of the Fe-based soft magnetic alloy powders, 0.4 parts by weight of zinc stearate was added to the resulting granulated powder and mixed to form a mixture for pressing.

The resulting mixture was pressed under a pressure of 0.74 GPa at room temperature using a press. The resulting compact had a toroidal shape with an inner diameter of 7.8 mmϕ, an outer diameter of 13.5 mmϕ, and a height of 4.3 mm. The resulting compact was heat-treated in the air under the conditions of a temperature of 750° C. and a holding time of 1.0 hour to form a powder magnetic core.

The density ds of each powder magnetic core prepared by the above process was calculated from its dimensions and mass. The space factor (relative density) was then calculated by dividing the density ds of the powder magnetic core by the true density of the Fe-based soft magnetic alloys (the massed average of the true densities of the soft magnetic alloy powders used). The maximum breaking load P (N) was also measured under a load in the direction of the diameter of the toroidal powder magnetic core, and the radial crushing strength or (MPa) was calculated from the following formula:

$$\sigma r = P(D-d)/(Id^2)$$

wherein D is the outer diameter (mm) of the core, d is the radial thickness (mm) of the core, and I is the height (mm) of the core.

Using 15 turns of wire on the primary side and 15 turns of wire on the secondary side, the core loss Pcv was measured under the conditions of a maximum magnetic flux density of 30 mT and a frequency of 300 kHz using B-H Analyzer SY-8232 manufactured by IWATSU TEST INSTRUMENTS CORPORATION. In addition, the toroidal powder magnetic core with 30 turns of wire was measured for initial magnetic permeability μi at a frequency of 100 kHz with 4284A manufactured by Hewlett-Packard Company. For direct current superimposed characteristics, the initial magnetic permeability (incremental permeability $\mu_\Delta$) was also measured under the application of a direct current magnetic field of 10 kA/m.

In addition, a conductive adhesive was applied to the two opposite flat surfaces of the toroidal magnetic core. After the adhesive was solidified by drying, the specific resistance (resistivity) of the magnetic core sample was evaluated as described below. Using an electric resistance meter (8340A manufactured by ADC Corporation), the resistance R (Ω) of the magnetic core sample was measured under the application of a direct current voltage of 50 V. The flat surface area A ($m^2$) and thickness t (m) of the magnetic core sample were measured, and the resistivity ρ (Ω·m) of the sample was calculated from the following formula.

$$\text{Resistivity } \rho\ (\Omega\cdot\text{m}) = R\times(A/t)$$

Figure 3:
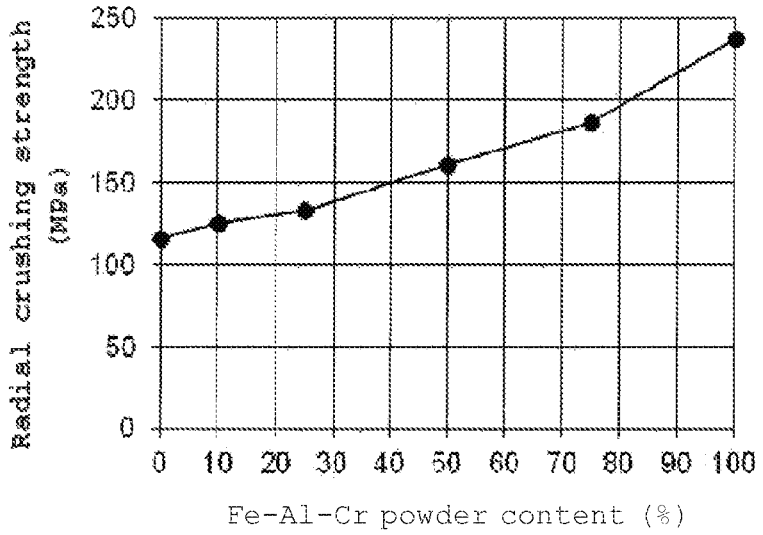
FIG. 3 is a graph showing the relationship between first Fe-based soft magnetic alloy powder content and radial crushing strength.
Figure 4:
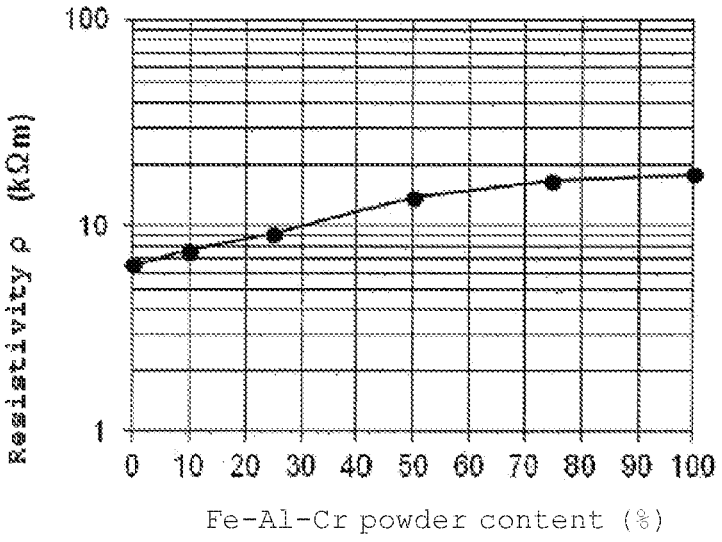
FIG. 4 is a graph showing the relationship between first Fe-based soft magnetic alloy powder content and resistivity.

The results obtained by the evaluations are shown in Table 1 and FIGS. 3 and 4.

TABLE 1

| No | Fe—Al—Cr alloy powder content (wt %) | ds ($\times10^3$ kg/$m^3$) | Space factor (%) | Radial crushing strength (MPa) | Pcv (kW/$m^3$) | μi | $\mu_\Delta$ | Resistivity ($\times10^3$ Ω · m) |
|---|---|---|---|---|---|---|---|---|
| 1 | 0 | 6.36 | 83.4 | 116 | 442 | 44.4 | 25.9 | 6.6 |
| 2 | 10 | 6.35 | 83.6 | 125 | 444 | 45.1 | 25.7 | 7.6 |
| 3 | 25 | 6.37 | 84.5 | 133 | 453 | 46.8 | 25.3 | 9.2 |
| 4 | 50 | 6.37 | 85.5 | 161 | 458 | 50.2 | 24.7 | 13.8 |
| 5 | 75 | 6.40 | 86.9 | 187 | 483 | 54.0 | 24.1 | 16.6 |
| 6 | 100 | 6.44 | 88.5 | 238 | 490 | 61.2 | 23.2 | 17.8 |

As shown in Table 1, the powder magnetic core No. 1, which was prepared using the Fe—Cr—Si soft magnetic alloy powder alone, is superior in core loss Pcv and incremental permeability $\mu_\Delta$, but insufficient in radial crushing strength. In contrast, it is apparent that the powder magnetic core Nos. 2 to 5, which were each prepared using a mixture of the Fe—Cr—Si soft magnetic alloy powder and the Fe—Al—Cr soft magnetic alloy powder, have a high radial crushing strength. Table 1 and FIG. 3 show that the space factor and the radial crushing strength increased with increasing Fe—Al—Cr soft magnetic alloy powder content. Particularly when the Fe—Al—Cr soft magnetic alloy powder content was 40% or more, the resulting powder magnetic cores exhibited a high strength of 150 MPa or more. Table 1 and FIG. 4 show that the resistivity also increased with increasing Fe—Al—Cr soft magnetic alloy powder content and that when the Fe—Al—Cr soft magnetic alloy powder content is 30% or more, the resulting powder magnetic cores exhibited a high resistivity of $1.0\times10^4$ Ω·m or more. Thus, it has been found that the use of a mixture of the Fe—Cr—Si soft magnetic alloy powder and the Fe—Al—Cr soft magnetic alloy powder makes it possible to obtain powder magnetic cores with high strength and high resistivity. The initial magnetic permeability also increased with increasing Fe—Al—Cr soft magnetic alloy powder content, and when the Fe—Al—Cr soft magnetic alloy powder content was 50% or more, the resulting powder magnetic cores exhibited a high initial magnetic permeability of 50 or more.

On the other hand, as the Fe—Al—Cr soft magnetic alloy powder content increased, the core loss Pcv slightly increased, whereas the incremental permeability tended to decrease slightly.

Figure 5:
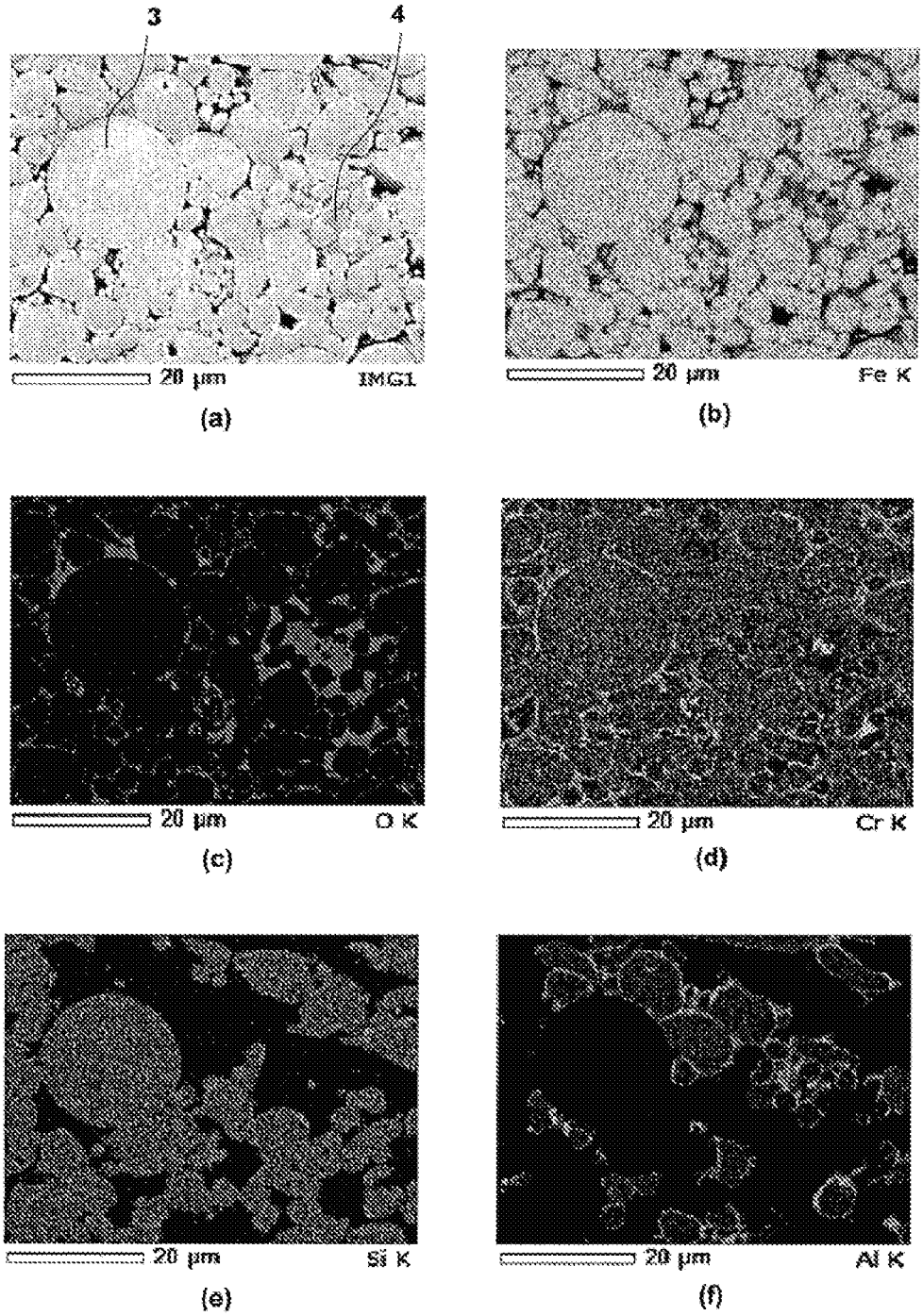
FIGS. 5(*a*) to 5(*f*) are an SEM image of the cross-section of a magnetic core according to the invention and elemental mappings.

Using a scanning electron microscope (SEM/EDX), the cross-section of the powder magnetic core No. 4 was observed, and the distribution of each constituent element in the powder magnetic core No. 4 was observed at the same time. FIGS. 5(*a*) to 5(*f*) show the results. FIG. 5(*a*) is an SEM image. It is apparent that the powder magnetic core has a structure including dispersed Fe-based soft magnetic alloy particles 3, which have a bright gray tone. As a result of the observation of cross-sections including other observation fields of view, no alloy particles with a maximum size of more than 40 μm were observed, and the percentage of the number of such particles was 0.0%.

FIGS. 5(*b*) to 5(*f*) are elemental mappings showing the distributions of Fe, O (oxygen), Cr, Si, and Al, respectively. The brighter color tone indicates the higher content of the object element. In FIG. 5(*f*) showing the distribution of Al, the white portions indicate the first Fe-based soft magnetic alloy particles. In FIG. 5(*e*) showing the distribution of Si, the white portions indicate the second Fe-based soft magnetic alloy particles. It is apparent from FIGS. 5(*a*) to 5(*f*) that the powder magnetic core has a structure including dispersed first Fe-based soft magnetic alloy particles containing Al and Cr and dispersed second Fe-based soft magnetic alloy particles containing Cr and Si. It is also apparent that the surface (gain boundary) of each Fe-based soft magnetic alloy particle is oxygen-rich and forms an oxide and that the Fe-based soft magnetic alloy particles are bonded together through the oxide. The SEM observation also shows that the first and second Fe-based soft magnetic alloy particles are all polycrystalline.

It has been found that the Fe concentration is lower at the surface (grain boundary) of each Fe-based soft magnetic alloy particle than in the inner part and that the Al concentration is significantly higher at the surface of the first Fe-based soft magnetic alloy particles containing Al and Cr. These facts have demonstrated that an oxide layer with a ratio of Al to the sum of Fe, Al, and Cr of higher than that of the inner alloy phase is formed on the surface of the first Fe-based soft magnetic alloy particles. It has also been found that the Cr concentration is significantly higher at the surface of the second Fe-based soft magnetic alloy particles containing Cr and Si and that there is no clear difference in Si concentration between the surface and interior of the second Fe-based soft magnetic alloy particles. These facts have demonstrated that an oxide layer with a ratio of Cr to the sum of Fe, Cr, and Si of higher than that of the inner alloy phase is formed on the surface of the second Fe-based soft magnetic alloy particles. The above element distribution tendency for the first and second Fe-based soft magnetic alloy particles was significant at each of the site where the first Fe-based soft magnetic alloy particles were adjacent to each other and the site where the second Fe-based soft magnetic alloy particles were adjacent to each other. Both an Al-rich site and a Cr-rich site were observed at the grain boundary where the first and second Fe-based soft magnetic alloy particles were adjacent to each other.

In addition, the concentration distribution of each constituent element as shown in FIGS. 5(*a*) to 5(*f*) was not observed before the heat treatment, which showed that the oxide layer was formed by the heat treatment. It is also suggested that the high resistivity, the low core loss, and other properties are attributable to the configuration that each particle is coated with the high-Al-content oxide layer or the high-Cr-content oxide layer. It is also suggested that the improvement in strength is also attributable to the configuration that the Fe-based soft magnetic alloy particles are bonded together through the boundary phase (oxide layer) as shown in FIGS. 5(*a*) to 5(*f*).

Figure 6:
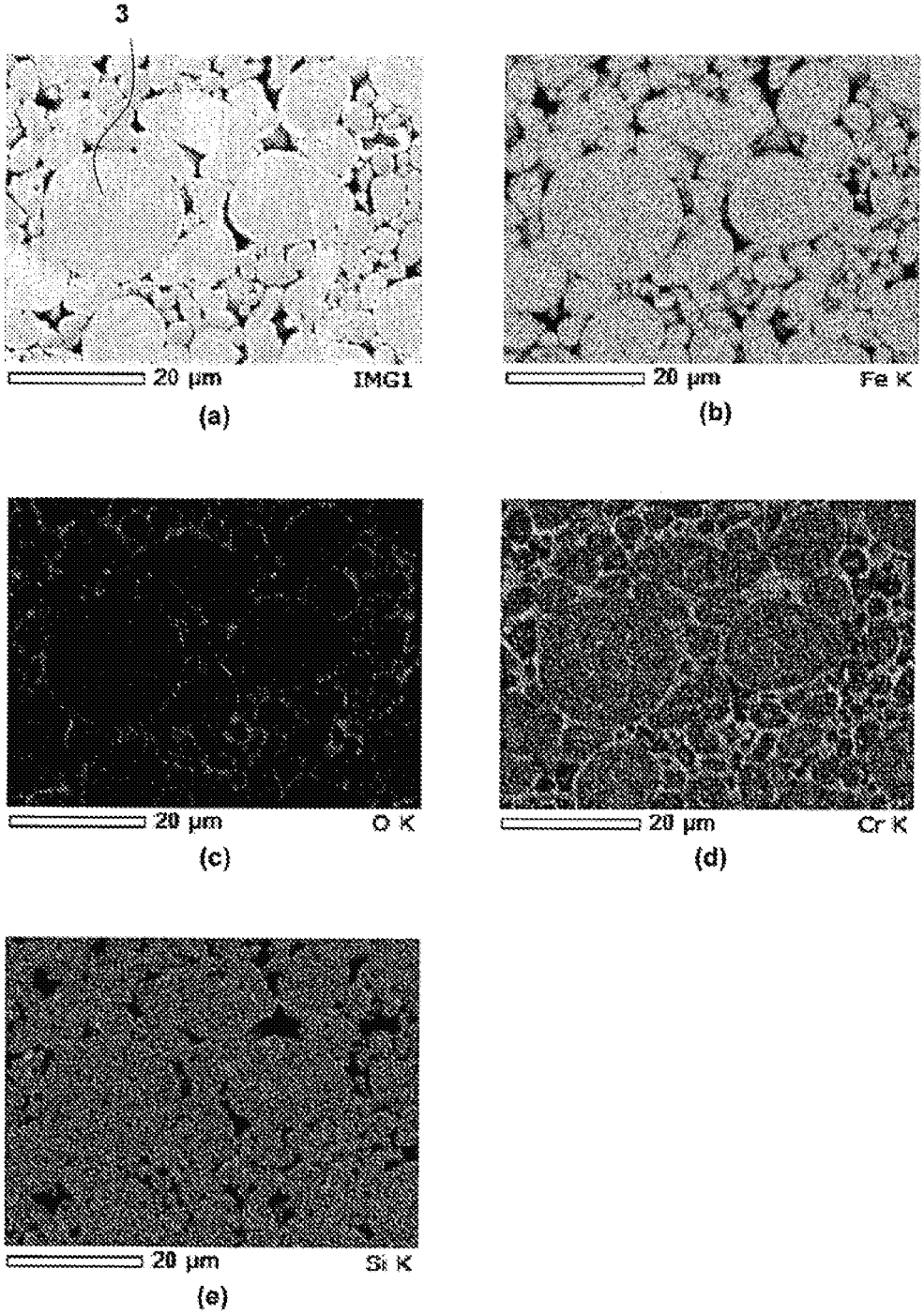
FIGS. 6(*a*) to 6(*e*) are an SEM image of the cross-section of a magnetic core according to a comparative example and elemental mappings.

As shown in FIGS. 5(*a*) to 5(*f*), a non-layered bulk oxide 4 formed along the shape of the gap between the Fe-based soft magnetic alloy particles was also observed in the region where the first Fe-based soft magnetic alloy particles were gathered. The elemental mappings of FIGS. 5(*b*) to 5(*f*) indicate that the bulk oxide 4 is relatively high not only in Al content but also in Fe content. For comparison, FIGS. 6(*a*) to 6(*e*) show elemental mappings of the magnetic core No. 1, which is free of the first Fe-based soft magnetic alloy particles. FIG. 6(*a*) is an SEM image. FIGS. 6(*b*) to (6*e*) show the distributions of Fe, O (oxygen), Cr, and Si, respectively. As shown in FIGS. 6(*a*) to 6(*e*), the bulk oxide was not clearly observed in the magnetic core No. 1 in contrast to the magnetic core No. 4 where the bulk oxide was observed. Therefore, the existence of the bulk oxide also seems to be related to the improvement in strength.

DESCRIPTION OF REFERENCE SIGNS

1 columnar body
2 flange
3 Fe-based soft magnetic alloy particle
4 bulk oxide

The invention claimed is:

1. A method for manufacturing a magnetic core having a structure comprising dispersed Fe-based soft magnetic alloy particles, the method comprising:

a first step comprising mixing a first Fe-based soft magnetic alloy powder containing Al and Cr, a second Fe-based soft magnetic alloy powder containing Cr and Si, and a binder;

a second step comprising pressing a mixture obtained after the first step; and a third step comprising heat-treating a compact obtained after the second step, wherein the heat treatment oxidizes the dispersed Fe-based soft magnetic alloy particles to form an oxide layer on a surface of the dispersed Fe-based soft magnetic alloy particles and bonds the dispersed Fe-based soft magnetic alloy particles together through the oxide layer, wherein the oxide layer is grown by reaction of oxygen with the Fe-based soft magnetic alloy particles in the heat treatment, and the oxide layer is formed by an oxidation reaction which proceeds beyond a natural oxidation of the Fe-based soft magnetic alloy particles.

2. The method according to claim 1, wherein a mass ratio of the first Fe-based soft magnetic alloy powder to the total of the first and second Fe-based soft magnetic alloy powders is 40% or more.

3. The method according to claim 1, wherein the heat treatment is performed in an oxygen-containing atmosphere or a water vapor-containing atmosphere.

4. The method according to claim 1, wherein the first Fe-based soft magnetic alloy powder has a Cr content of 4.5% by mass or less.

5. A method for manufacturing a magnetic core having a structure comprising dispersed Fe-based soft magnetic alloy particles, the method comprising:

a first step comprising mixing a first Fe-based soft magnetic alloy powder containing Al and Cr, a second Fe-based soft magnetic alloy powder containing Cr and Si, and a binder;

a second step comprising pressing a mixture obtained after the first step; and a third step comprising heat-treating a compact obtained after the second step, wherein the heat treatment oxidizes the dispersed Fe-based soft magnetic alloy particles to form an oxide layer on a surface of the dispersed Fe-based soft magnetic alloy particles and bonds the dispersed Fe-based soft magnetic alloy particles together through the oxide layer, wherein a percentage of a number of alloy particles of the magnetic core with a maximum size of more than 40 μm is less than 1.0% in a cross-sectional observation image of the magnetic core.

6. A method for manufacturing a magnetic core having a structure comprising dispersed Fe-based soft magnetic alloy particles, the method comprising:

a first step comprising mixing a first Fe-based soft magnetic alloy powder containing Al and Cr, a second Fe-based soft magnetic alloy powder containing Cr and Si, and a binder;

a second step comprising pressing a mixture obtained after the first step; and a third step comprising heat-treating a compact obtained after the second step, wherein the heat treatment oxidizes the dispersed Fe-based soft magnetic alloy particles to form an oxide layer on a surface of the dispersed Fe-based soft magnetic alloy particles and bonds the dispersed Fe-based soft magnetic alloy particles together through the oxide layer, wherein the first Fe-based soft magnetic alloy powder has an Fe content of 80% by mass or more, a Cr content of 1.0% by mass or more and 9.0% by mass or less, an Al content of 2.0% by mass or more and 10.0% by mass or less, and a remainder being inevitable impurities, and wherein the second Fe-based soft magnetic alloy powder has an Fe content of 80% by mass or more, a Cr content of 1.0% by mass or more and 9.0% by mass or less, a Si content of 1.0% by mass or more and 10.0% by mass or less, and a remainder being inevitable impurities.

* * * * *